US008348384B2

(12) United States Patent
Sato et al.

(10) Patent No.: US 8,348,384 B2
(45) Date of Patent: Jan. 8, 2013

(54) ROTATIONAL ADJUSTMENT APPARATUS FOR INKJET COATING HEAD

(75) Inventors: Seiichi Sato, Kanagawa (JP); Mitsuru Yahagi, Kanagawa (JP)

(73) Assignee: ULVAC, Inc., Kanagawa (JP)

( * ) Notice: Subject to any disclaimer, the term of this patent is extended or adjusted under 35 U.S.C. 154(b) by 197 days.

(21) Appl. No.: 13/055,196

(22) PCT Filed: Mar. 4, 2010

(86) PCT No.: PCT/JP2010/001500
§ 371 (c)(1),
(2), (4) Date: Jan. 21, 2011

(87) PCT Pub. No.: WO2010/100928
PCT Pub. Date: Sep. 10, 2010

(65) Prior Publication Data

US 2011/0122193 A1 May 26, 2011

(30) Foreign Application Priority Data

Mar. 6, 2009 (JP) ..... 2009-054151

(51) Int. Cl.
*B41J 23/00* (2006.01)

(52) U.S. Cl. ..... 347/38

(58) Field of Classification Search ..... 347/38, 347/4–5

See application file for complete search history.

(56) References Cited

U.S. PATENT DOCUMENTS 7,238,234 B2 * 7/2007 Bae et al. ..... 118/302
7,556,690 B2 * 7/2009 Goto ..... 118/323
7,604,848 B2 * 10/2009 Iwata ..... 427/542
2001/0050341 A1 12/2001 Kwan et al.
2006/0146379 A1 7/2006 Katagami et al.

FOREIGN PATENT DOCUMENTS

JP 2002-025902 A 1/2002
JP 2002-273868 A 9/2002
JP 2006-043682 A 2/2006

OTHER PUBLICATIONS

International Search Report for PCT Patent App. No. PCT/JP2010/001500 (Jun. 8, 2010).

* cited by examiner

*Primary Examiner* — Lamson Nguyen
(74) *Attorney, Agent, or Firm* — Cermak Nakajima LLP; Tomoko Nakajima

(57) ABSTRACT

There is provided a small-sized and inexpensive rotational adjustment apparatus for a linearly moveable inkjet coating head 6 without providing a rotary mechanism which is separate from and independent of a linear movement mechanism. The apparatus is capable of performing a rotational adjustment, about a rotary axis in a Z-axis direction, of the inkjet coating head in which the Z-axis direction is orthogonal to an X-axis direction which is a direction of movement of the coating head. The apparatus has: first and second moveable bodies, two in total, which are linearly moved by separate driving sources in the X-axis direction; and a converting mechanism which converts the inkjet coating head into a linear movement in the X-axis direction when the first and second moveable bodies synchronously move in the X-axis direction, and into a rotary movement, about the rotary axis of the inkjet coating head, when both the first and the second moveable bodies make a relative movement in the X-axis direction.

15 Claims, 5 Drawing Sheets

ROTATIONAL ADJUSTMENT APPARATUS FOR INKJET COATING HEAD

This application is a national phase entry under 35 U.S.C. §371 of PCT Patent Application No. PCT/JP2010/001500, filed on Mar. 4, 2010, which claims priority under 35 U.S.C. §119 to Japanese Patent Application No. 2009-054151, filed Mar. 6, 2009, both of which are incorporated by reference.

TECHNICAL FIELD

The invention relates to a rotational adjustment apparatus for inkjet coating head which is linearly moveable, the rotational adjustment being made about a rotary axis orthogonal to the direction of movement of the inkjet coating head.

BACKGROUND ART

It is known to use an inkjet coating apparatus in order to form electrically conductive fine patterns and the like directly on a substrate without passing through photolithography steps. In addition, an inkjet coating apparatus is recently used also in forming highly fine source-drain electrode patterns of several μm in the process of manufacturing large-area thin transistor substrates, and also used in forming color filters, alignment layers, and spacers for flat panel displays.

As this kind of coating apparatus, there is conventionally known one as described in patent document 1. The apparatus in question is provided with a stage for supporting in suction the substrate, and an inkjet coating head. The stage is linearly moveable in one axial direction (Y-axis direction). The coating head is supported by a portal frame which is provided in a moving path of the stage so as to bridge the stage. The coating head is supported in a manner to be moveable in a direction (X-axis direction) orthogonal to the direction of movement of the stage. In addition, the coating head has disposed therein a plurality of nozzles in array in a direction orthogonal to a direction (Z-axis direction) which is orthogonal to the X-axis direction and to the Y-axis direction. The coating head is arranged to be adjustable in rotation (also referred to as "rotational adjustment") about a rotary axis in the Z-axis direction. As a result of this rotational adjustment, the component in the X-axis direction of a pitch between respective nozzles (nozzle-to-nozzle pitch) can be made variable. According to this arrangement, at the time of moving the stage in the Y-axis direction to coat the substrate with liquid droplets from each of the nozzles, the coating pitch in the X-axis direction can be made smaller than the nozzle-to-nozzle pitch.

In the above-mentioned conventional example, the coating head is arranged to be capable of rotational adjustment about the rotary axis by means of a rotating mechanism having a driving source separate from and independent of the mechanism for causing a linear movement of the coating head in the X-axis direction. As a result, there is a disadvantage in that the apparatus becomes larger in size and the cost becomes higher.

PRIOR ART DOCUMENT

Patent Document

Patent Document 1: JP-A-2002-273868

DISCLOSURE OF THE INVENTION

Problems to be Solved by the Invention

In view of the above points, this invention has a problem of providing a small-sized and inexpensive rotational adjustment apparatus in which an inkjet coating head can be adjustable in rotation without providing a rotary mechanism which is separate from and independent of the linear movement mechanism.

Means for Solving the Problems

In order to solve the above-mentioned problem, this invention is a rotational adjustment apparatus for an inkjet coating head. The apparatus is for performing a rotational adjustment, about a rotary axis in a Z-axis direction, of a linearly movable inkjet coating head, the Z-axis direction being orthogonal to an X-axis direction which is a direction of movement of the coating head. The apparatus comprises: two moveable bodies made up of a first moveable body and a second moveable body, each being linearly moveable in the X-axis direction by an independent driving source; and a converting mechanism so constructed and arranged: that, when both the first moveable body and the second moveable body move synchronously in the X-axis direction, the inkjet coating head is linearly moved in the X-axis direction; and that, when both the moveable bodies make relative movements in the X-axis direction, the relative movements are converted to a rotary movement of the inkjet coating head about the rotary axis in the Z-axis direction.

According to this invention, by relatively moving in the X-axis direction the first moveable body and the second moveable body which constitute a linear movement mechanism, the inkjet coating head can be subjected to a rotational adjustment about the rotary axis through the converting mechanism. In this invention, there will be needed two driving sources, one for the first moveable body and the other for the second moveable body. However, as a result of synchronous movement of both the first moveable body and the second moveable body, the inkjet coating head is linearly moved in the X-axis direction. Therefore, the load to be operated on each of the driving sources will be half the load for the linear movement of the inkjet coating head. It follows that each of the driving sources may be of a small-sized one with a low output. In conjunction with the fact that the driving source for the rotary mechanism of the inkjet coating head is not required, the apparatus can be miniaturized and reduced in cost.

By the way, it is possible to detect the rotational angle of the inkjet coating head about the rotary axis by means of a rotary encoder. However, in order to control the rotational angle with a higher accuracy, an encoder of higher resolution will be required, resulting in a higher cost. As a solution, in this invention, a relative positional relationship in the X-axis direction of both the moveable bodies is preferably ascertained by a linear scale, and a rotational angle of the inkjet coating head about the rotary axis is computed based on the positional relationship. In this invention, the relative movement in the X-axis direction of both the first moveable body and the second moveable body is converted to the rotational movement of the inkjet coating head. Therefore, by securing an appropriate distance between the inkjet coating head and both the moveable bodies, the inkjet coating head can be rotated at a minute angle compared with the relative positional deviation in the X-axis direction of both the moveable bodies. As a consequence, even if the resolution of the relative positional relationship, to be ascertained by the linear scale, in the X-axis direction of both the moveable bodies is not very high, the rotational angle of the inkjet coating head can be detected at a higher resolution.

Further, in case a plurality of the inkjet coating heads are disposed in alignment in the X-axis direction, preferably, the apparatus further comprises: a plurality of the converting mechanisms for the plurality of the inkjet coating heads; a first driving source for linearly moving in the X-axis direction the one or the plurality of the first moveable bodies for the plurality of inkjet coating heads; and a second driving source for linearly moving in the X-axis direction the one or the plurality of the second moveable bodies for the plurality of inkjet coating heads. According to this arrangement, by relatively moving in the X-axis direction the first moveable body and the second moveable body by means of the first driving source and the second driving source, the plurality of inkjet coating heads can advantageously be subjected to a rotational adjustment at the same time.

Let the direction orthogonal to the X-axis direction and to the Z-axis direction be defined as a Y-axis direction, the first movable body and the second movable body are disposed opposite to each other in the Y-axis direction on both sides of the rotary axis. The converting mechanism is made up of: an arm which is elongated in the Y-axis direction and is connected to the inkjet coating head so as to be rotatable about the rotary axis integrally with the inkjet coating head; a first coupling part for coupling one end portion in the Y-axis direction of the arm to the first movable body while keeping two-axis freedom of movement in the Y-axis direction and of rotation about the axial line in the Z-axis direction; and a second coupling part which couples the other end part in the Y-axis direction of the arm to the second moveable body while keeping two-axis freedom of movement in the Y-axis direction and of rotation about the axial line in the Z-axis direction. Further, preferably, the first movable body is made up of a supporting body which supports the inkjet coating head so as to be rotatable about the rotary axis, and the second movable body is disposed away from the rotary axis to one side in the Y-axis direction. The converting mechanism is made up of an arm extending to one side in the Y-axis direction, the arm being connected to the inkjet coating head so as to be rotatable about the rotary axis integrally with the inkjet coating head; and a coupling part for coupling one end portion in the Y-axis direction of the arm to the second movable body while keeping two-axis freedom of a movement in the Y-axis direction and a rotation about the rotary axis in the Z-axis direction.

Further, in case the inkjet coating head comprises a plurality of nozzles arrayed in the direction orthogonal to the rotary axis, the coating head can be rotated for performing rotational adjustment. Then, the X-axis component of the nozzle-to-nozzle pitch can be made variable so that the coating pitch in the X-axis direction can be narrowed below the nozzle-to-nozzle pitch.

BEST MODE FOR CARRYING OUT THE INVENTION

Figure 1:
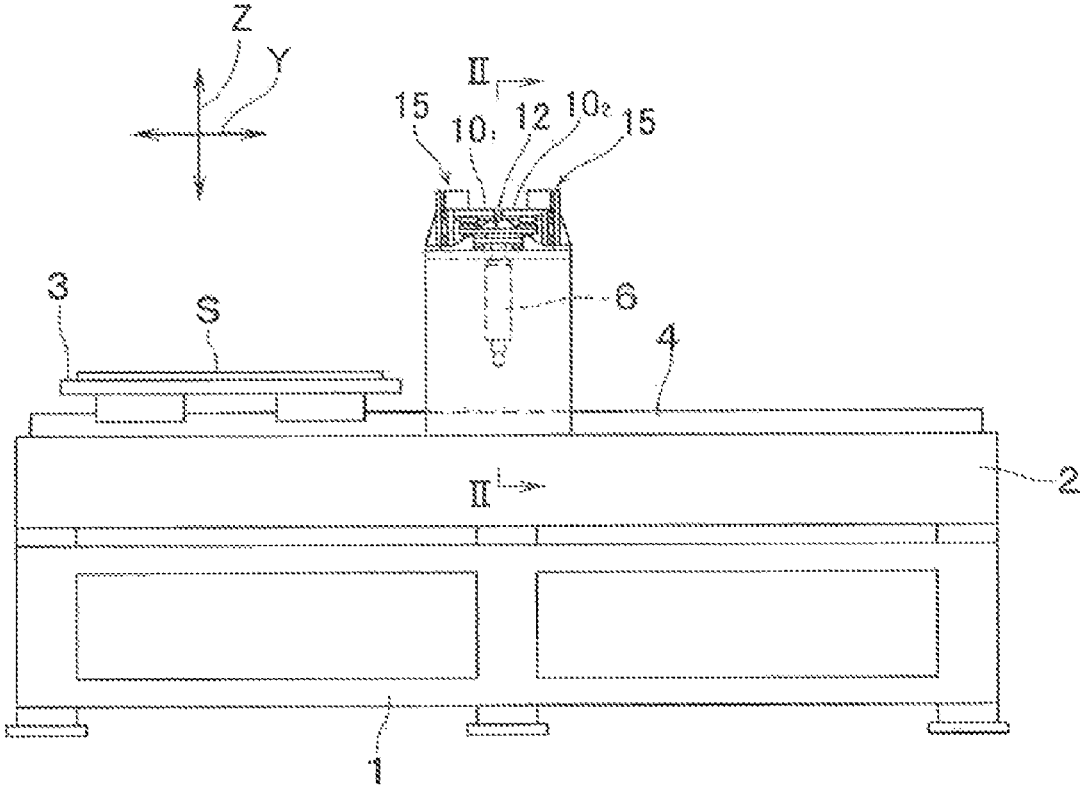
FIG. 1 is a side view of a coating apparatus provided with a rotational adjustment apparatus according to a first embodiment of this invention.
Figure 2:
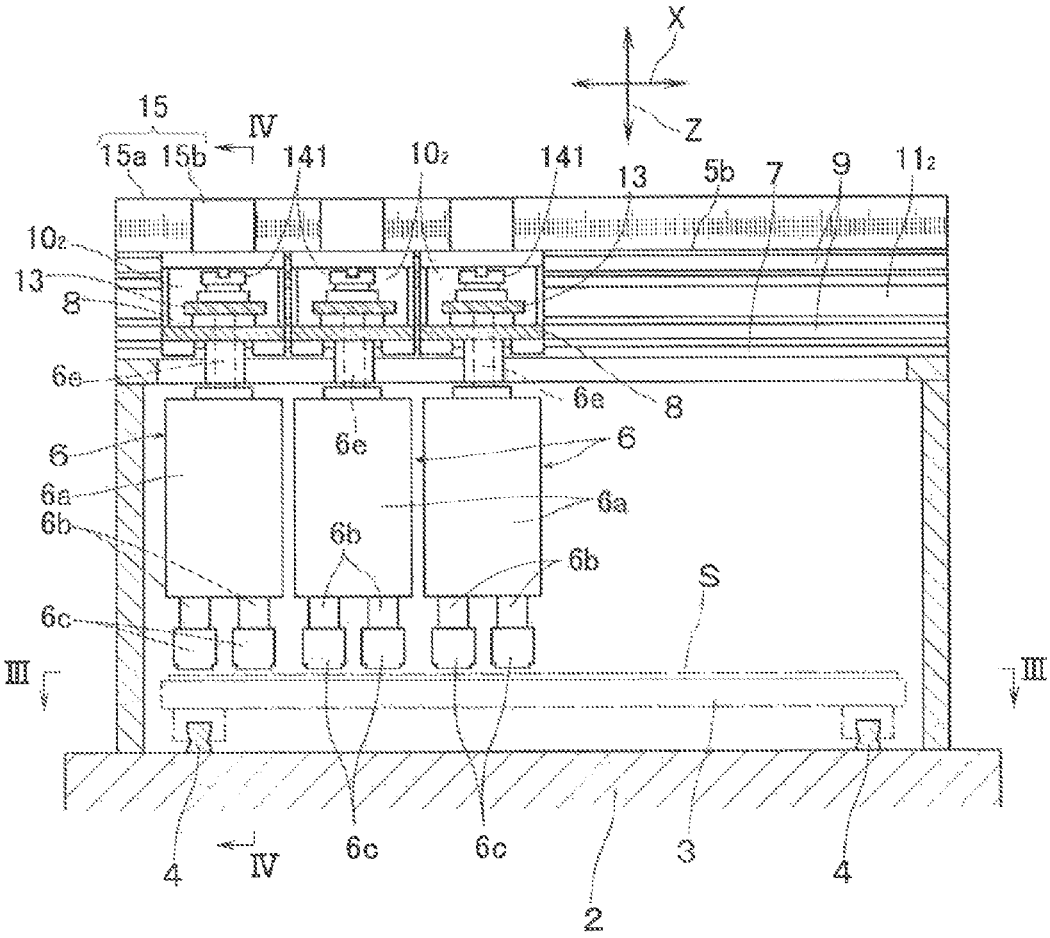
FIG. 2 is a cross-sectional front view taken along line II-II in FIG. 1.
Figure 3:
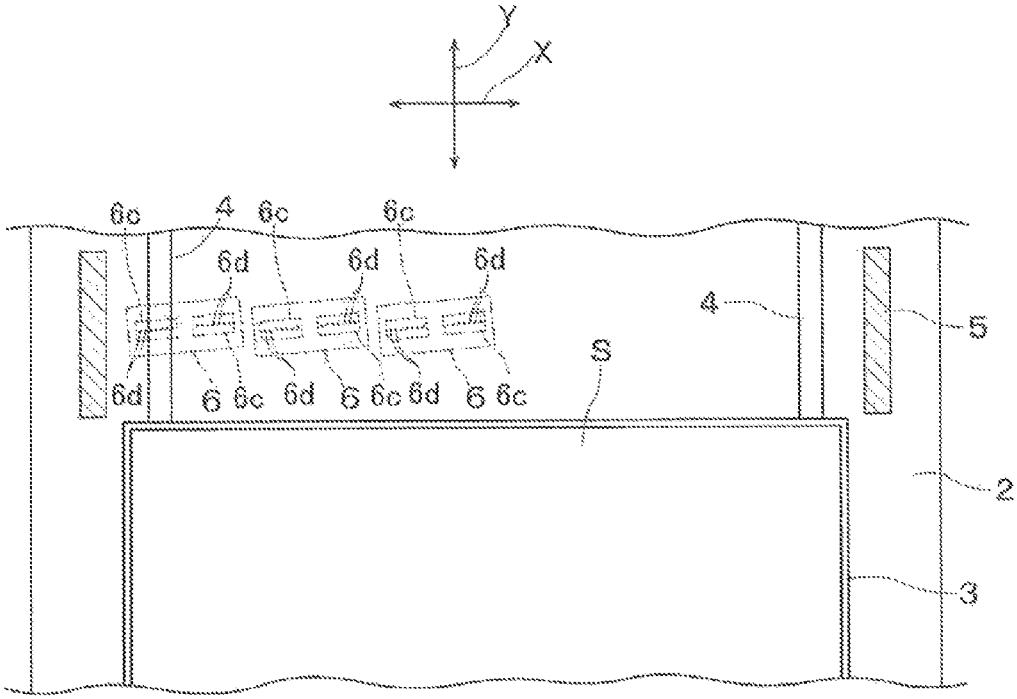
FIG. 3 is a cross-sectional plan view taken along line III-III in FIG. 2.

FIG. 1 through FIG. 3 show an inkjet type of coating apparatus (inkjet coating apparatus) which is provided with a rotational adjustment apparatus according to an embodiment of this invention. This inkjet coating apparatus is provided with a platform 1. On the platform 1 there is disposed a base plate 2 in a shape of a rectangular parallelepiped. A stage 3 for holding by suction a substrate S as an object to be processed is supported on the base plate 2 in a manner to be moveable in a horizontal one-axis direction (Y-axis direction) along guide rails 4 which are fixed to an upper surface of the base plate 2. It is thus so arranged that the stage 3 is moveable back and forth in the Y-axis direction by means of a motor (not illustrated) through a feed screw mechanism.

A portal frame 5 elongated in the horizontal direction (X-axis direction) orthogonal to the Y-axis direction is disposed on the base plate 2 in a manner to bridge a moving path of the stage 3. Then, a plurality of inkjet coating heads 6 are suspended from the frame 5 in a manner arrayed in the X-axis direction.

Figure 4:
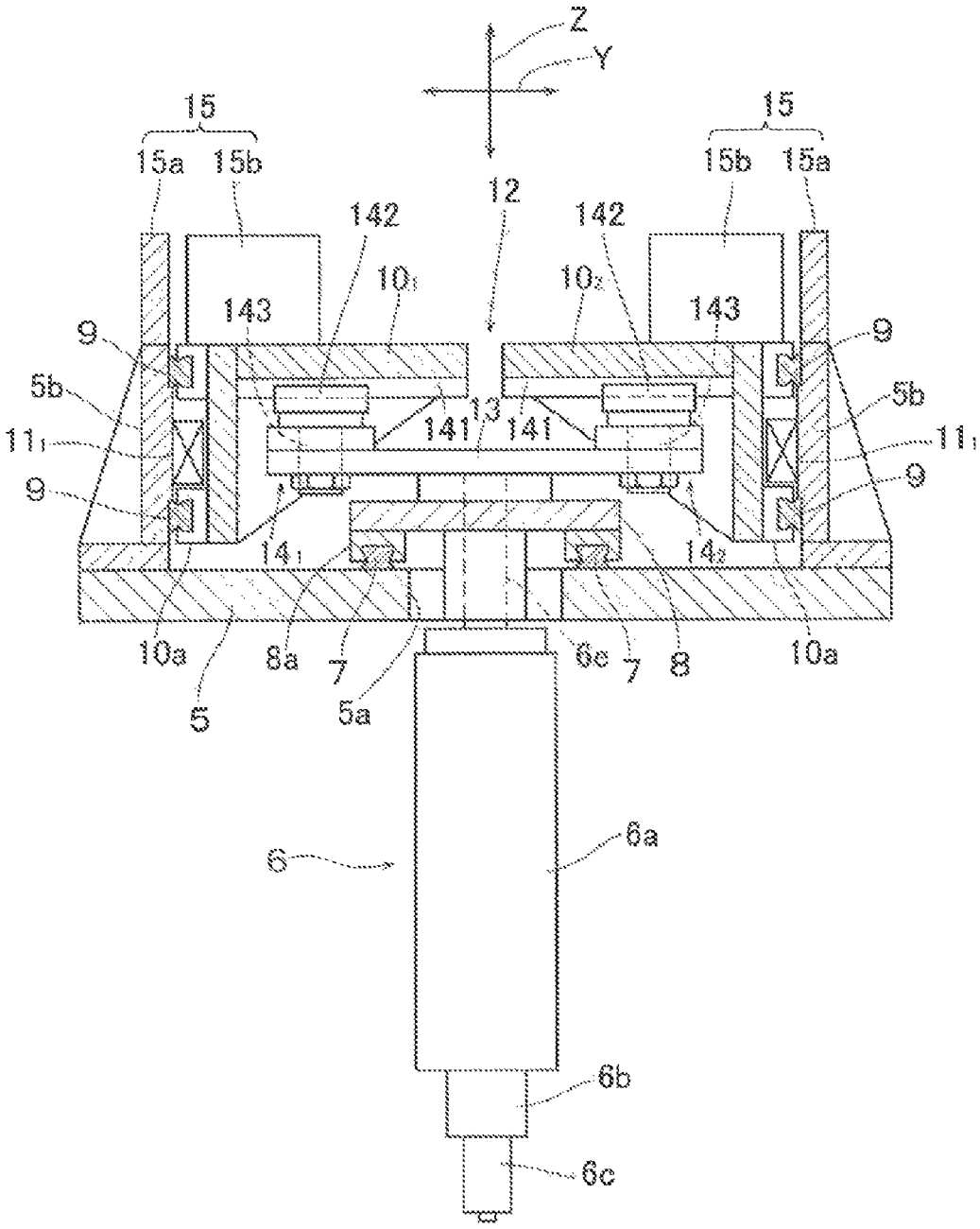
FIG. 4 is an enlarged cross-sectional side view taken along line IV-IV in FIG. 2.

Each of the coating heads 6 is, as shown in FIG. 4, of a known construction which is provided with an ink tank 6*a*, and nozzle heads 6*c* which are mounted on a lower end of the ink tank 6*a* through ink chambers 6*b*. It is thus so arranged that, by appropriately driving a piezoelectric element provided in the ink chambers 6*b*, a liquid to be processed and which is contained in the ink tank 6*a* is dropped out of nozzles 6*d* (see FIG. 3) that are formed on a lower surface of the nozzle head 6*c*. The nozzles 6*d* are arrayed in a direction orthogonal to a Z-axis direction which is orthogonal to the X-axis direction and to the Y-axis direction. Each of the coating heads 6 is provided with a pair of nozzle heads 6*c* at a distance from each other in a direction in which the nozzles 6*c* are arrayed.

In this embodiment, each of the coating heads 6 is arranged to be moveable in the X-axis direction and is also arranged to be rotationally adjustable (i.e., adjustable in rotation) about a rotary axis in the Z-axis direction. Description will now be made of this point. A supporting shaft 6*e* in the Z-axis direction is vertically disposed on the ink tank 6*a* of each of the coating heads 6. The frame 5 has formed therein a slit 5*a* which is elongated in the X-axis direction and into which is inserted the supporting shaft 6*e*. A pair of guide rails 7 which are elongated in the X-axis direction are fixed to both sides of the slit 5*a* on the frame 5. There is provided a supporting body 8 which rotatably suspends each of the coating heads 6 by the supporting shaft 6*e*. This supporting body 8 is slidably engaged with the guide rails 7 through sliders 8*a*.

In a manner to be away from the slit 5*a* on one side, and on the other side, respectively in the Y-axis direction, there are vertically provided on the frame 5 a pair of rail supporting plates 5*b* which are elongated in the X-axis direction. A pair of upper and lower guide rails 9 which are elongated in the X-axis direction are fixed to the respective supporting plates 5*b*. There are further provided: a first moveable body $\mathbf{10}_1$ which slidably engages, through sliders 10*a*, with the guide rails 9 that are fixed to the rail supporting plate 5*b* on one side as seen in the Y-axis direction (left side in FIG. 4); and a second moveable body $\mathbf{10}_2$ which slidably engages, through sliders 10*a*, with the guide rails 9 that are fixed to the rail supporting plate 5*b* on the other side as seen in the Y-axis direction (right side in FIG. 4).

The first moveable body $\mathbf{10}_1$ is provided in a plurality of pieces corresponding to the plurality of coating heads 6. These first moveable bodies $\mathbf{10}_1$ are moved synchronously in the X-axis direction by a common first driving source $\mathbf{11}_1$ which is made up of a linear motor. Similarly, the second moveable body $\mathbf{10}_2$ is provided in a plurality of pieces corresponding to the plurality of coating heads 6. These second moveable bodies $10_2$ are moved synchronously in the X-axis direction by a common first driving source $11_1$ which is made up of a linear motor.

There is further provided a converting mechanism 12 which: when both the first moveable body $10_1$ and the second moveable body $10_2$ make a synchronous movement in the X-axis direction, the coating head 6 is linearly moved in the X-axis direction; and when the first moveable body $10_1$ and the second moveable body $10_2$ make a relative movement in the X-axis direction, this relative movement is converted to a rotary movement of the coating head 6 about the axial line (axis of rotation) of the supporting shaft 6*e* of the coating head 6. This converting mechanism 12 is made up of: an arm 13 which is elongated in the Y-axis direction and is coupled to the supporting shaft 6*e* so as to be rotatable integrally with the coating head 6; a first coupling part $14_1$ which couples one end part as seen in the Y-axis direction of the arm 13 to the first moveable body $10_1$ while keeping two-axis freedom of movement in the Y-axis direction and of rotation about the axial line in the Z-axis direction; and a second coupling part $14_2$ which couples the other end part as seen in the Y-axis direction of the arm 13 to the second moveable body $10_2$ while keeping two-axis freedom of movement in the Y-axis direction and of rotation about the axial line in the Z-axis direction. The converting mechanism 12 is provided in a plurality of pieces to correspond to the plurality of coating heads 6.

Each of the first and the second coupling parts $14_1$ and $14_2$ has a slider 142 which is suspended, in a slidable manner, from a guide rail 141 provided in each of the first and the second moveable bodies $10_1$ and $10_2$ in a manner to extend inward in the Y-axis direction. An axial part 143 in the Z-axis direction which is vertically and downwardly provided on the slider 142 is coupled to an end portion of the arm 13 in a manner to be rotatable. According to this arrangement, the freedom of movement in the Y-axis direction can be secured by the slider 142, and the freedom of rotation about the axial line in the Z-axis direction can be secured by the axial part 143.

When both the first and the second moveable bodies $10_1$ and $10_2$ are synchronously moved in the X-axis direction, both the first and the second coupling parts $14_1$ and $14_2$ also move synchronously in the X-axis direction. Therefore, the coating head 6 will be caused to linearly move in the X-axis direction through the arm 13. On the other hand, when the first and the second moveable bodies $10_1$ and $10_2$ are relatively moved in the X-axis direction, e.g., when the first moveable body $10_1$ is moved in one X-axis direction and the second moveable body $10_2$ is moved in the other X-axis direction, the first and the second coupling parts $14_1$ and $14_2$ will give rise to a relative positional deviation in the X-axis direction. The arm 13 will thus be rotated about the axial line of the supporting shaft 6*e* by the amount corresponding to this deviation. The coating head 6 will also be rotated integrally with the arm 13.

On each of the rail supporting plates 5*b*, there is fixed a graticule (scale plate) 15*a* of a linear scale 15. On at least one of the first moveable body $10_1$ and the second moveable body $10_2$, there is fixedly mounted a detection head 15*b* for the linear scale 15. Each of the first and the second driving sources $11_1$, $11_2$ is controlled by detecting with the linear scale 15 the position in the X-axis direction of each of the first and the second moveable bodies $10_1$, $10_2$. In an arrangement in which each of the first and the second moveable bodies $10_1$, $10_2$, is provided in respective coating heads 6, the distance between the respective coating heads 6 can be adjusted. Therefore, in this embodiment, in order to confirm the position of the respective coating heads 6 after adjustment, each of the coating heads 6 is provided with the detection head 15*b* of the linear scale 15.

In performing the rotational adjustment of each of the coating heads 6, the following steps are taken. That is, from the linear scale 15 for the first moveable body $10_1$ and from the linear scale 15 for the second moveable body $10_2$, the relative positional relationship between the first and the second moveable bodies $10_1$ and $10_2$ in the X-axis direction is grasped. Out of this relative positional relationship the angle of rotation of the coating head 6 is computed. In order for this angle of rotation to become a required angle, control is made such that both the first and the second moveable bodies $10_1$ and $10_2$ are relatively moved in the X-axis direction.

In this embodiment, the relative movement of the first and the second moveable bodies $10_1$ and $10_2$ in the X-axis direction is converted to the rotational movement of the coating head 6. Therefore, if the distances between the supporting shaft 6*e* of the coating head 6 and both the first and the second moveable bodies $10_1$ and $10_2$ (i.e., the length of the arm 13) are appropriately secured, the coating head 6 can be rotated at an infinitesimal angle as compared with the deviation in the relative positional relationship in the X-axis direction of both the first and the second moveable bodies $10_1$ and $10_2$. Therefore, even if the resolution of the relative positional relationship in the X-axis direction of both the first and the second moveable bodies $10_1$ and $10_2$ to be grasped by the linear scales 15 is not high enough, the angle of rotation of the coating head 6 can be detected at a high resolution. In this manner, it becomes possible to perform the rotational adjustment of the coating head 6 with a high accuracy.

In subjecting the substrate S to the processing of coating, the stage 3 is moved in the Y-axis direction, and the coating head 6 is caused to scan the substrate S in the Y-axis direction. The substrate S is thus coated with liquid droplets out of the nozzles 6*d* in a given pattern. Then, the coating head 6 is linearly moved by the synchronous movement of the first and the second moveable bodies $10_1$ and $10_2$ in the X-axis direction by a predetermined distance. In this state, the operation of moving the stage 3 in the Y-axis direction is repeated.

In this embodiment, by performing the rotational adjustment of the coating head 6 as described above, the X-axis component of the nozzle-to-nozzle pitch can be varied. Therefore, when the coating head 6 scans the substrate S in the Y-axis direction to thereby coat the substrate S with the droplets from each of the nozzles 6*d*, the coating pitch in the X-axis direction can be made smaller than the nozzle-to-nozzle pitch.

Further, in this embodiment, there are required two driving sources for the first driving source $11_1$ of the first moveable body $10_1$ and for the second driving source $11_2$ of the second moveable body $10_2$. However, since the coating head 6 is linearly moved in the X-axis direction by the synchronous movement of both the first and the second moveable bodies $10_1$ and $10_2$, the load to be operated on each of the driving sources $11_1$, $11_2$ will be half the load that will be required in case the coating head 6 were to be linearly moved. Therefore, each of the driving sources $11_1$, $11_2$ may be of a small size of low output. As a result of a combined effect in that the driving source is not required for the rotary mechanism of the coating head 6, the apparatus can be miniaturized and its cost can be reduced.

Further, in this embodiment, a plurality of the first moveable bodies $10_1$ are moved in the X-axis direction by the common first driving source $11_1$, and a plurality of the second moveable bodies $10_2$ are moved in the X-axis direction by the common second driving source $11_2$. Therefore, by relatively moving these first moveable bodies $10_1$ and these second moveable bodies $10_2$ simultaneously in the X-axis direction, the plurality of coating heads 6 can be subjected to rotational adjustment at the same time.

The first and the second moveable bodies $10_1$, $10_2$ may respectively be arranged to be a single moveable body common to a plurality of coating heads 6. However, by separately preparing the first and the second moveable bodies $10_1$, $10_2$ for the respective coating heads 6 as in this embodiment, installation of additional coating heads 6 can advantageously be made easier.

Figure 5:
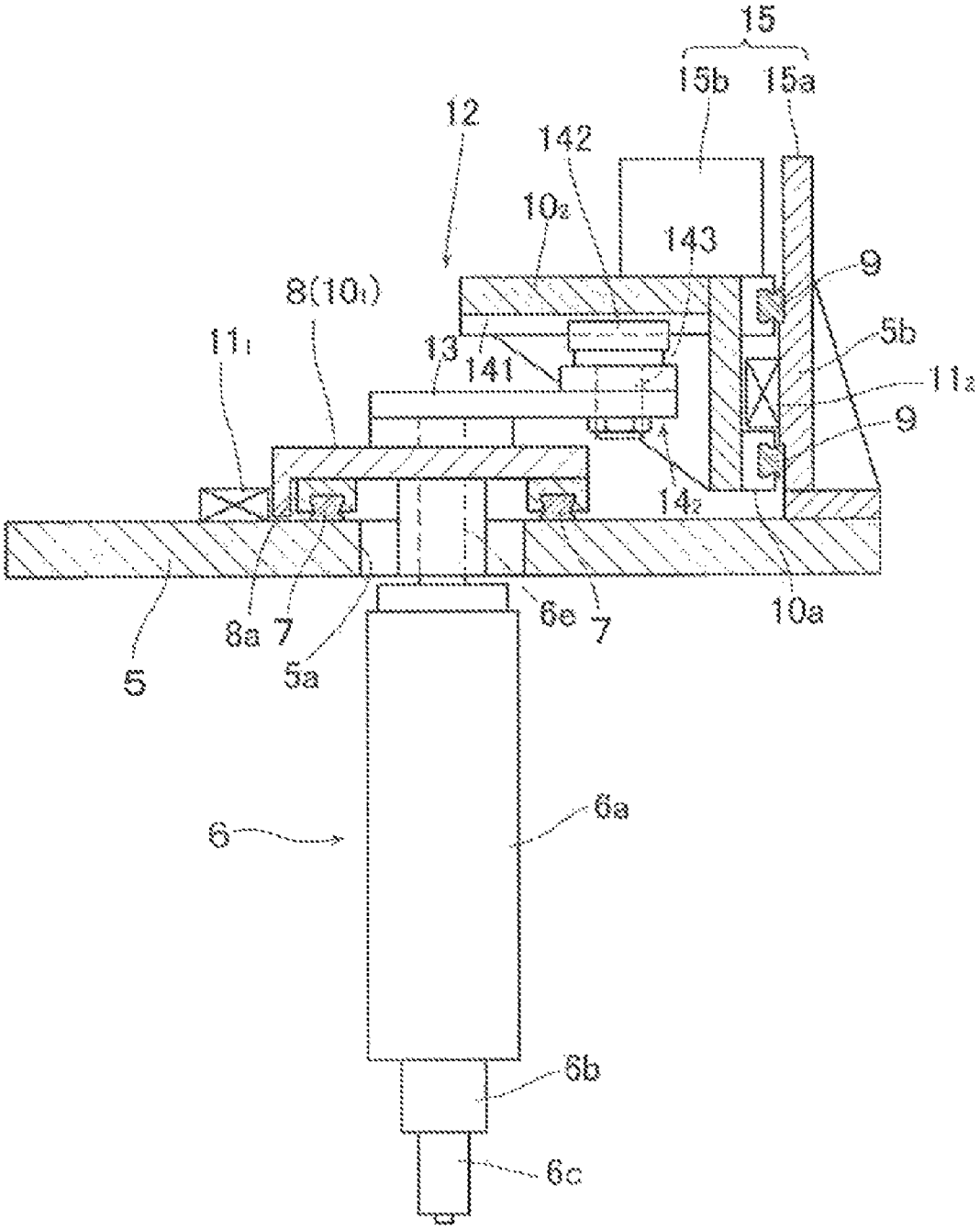
FIG. 5 is a cross-sectional side view of a second embodiment corresponding to that in FIG. 4.

A description will now be made of a second embodiment as shown in FIG. 5. The same reference numerals are assigned to the members and parts that are the same as those in the above-mentioned first embodiment. In the second embodiment, the first moveable body $10_1$ is constituted by the supporting body 8 which rotatably supports the coating head 6 with the supporting shaft 6*e*. And the supporting body 8 is arranged to be linearly moveable in the X-axis direction by the first driving source $11_1$ which is made up of a linear motor.

The second moveable body $10_2$ is constituted in a manner similar to the one in the above-mentioned first embodiment. The converting mechanism 12 is constituted by: an arm 13 which is fixed to an upper end of the supporting shaft 6*e* of the coating head 6 and which is elongated toward the second moveable body $10_2$, i.e., which extends toward one side in the Y-axis direction; and a coupling part 14 which couples one end, as seen in the Y-axis direction, of the arm 13 to the second moveable body $10_2$ while keeping the two-axis freedom of movement in the Y-axis direction and of rotation about an axial line in the Z-axis direction. The coupling part 14 has, in a manner similar to that in the first embodiment, the slider 142 which is slidably suspended from the guide rail 141 which is provided in the second moveable body $10_2$ and is elongated in the Y-axis direction. The axial part 143 which is vertically provided in this slider 142 so as to be elongated in the Z-axis direction, is rotatably coupled to an end portion of the arm 13.

Also in the arrangement of the second embodiment, when the supporting body 8 as the first moveable body $10_1$ and the second moveable body $10_2$ are synchronously moved in the X-axis direction, the coating head 6 will be linearly moved in the X-axis direction. When the supporting body 8 and the second moveable body $10_2$ are relatively moved in the X-axis direction, the coating head 6 will be rotated about the axial line of the supporting shaft 6*e*. There can thus be obtained the function and effect that are similar to those in the first embodiment.

Description has so far been made of embodiments of this invention with reference to the figures. This invention is, however, not limited thereto. For example, in the above-mentioned embodiments, each of the first and the second driving sources $11_1$, $11_2$ was constituted by a linear motor. It may, however, be so arranged that each of the first and the second driving sources $11_1$, $11_2$ is constituted by an ordinary servomotor so that the first and the second moveable bodies $10_1$, $10_2$ are moved in the X-axis direction by servomotors through feed screw mechanisms. In case servomotors are employed, if the first and the second moveable bodies $10_1$, $10_2$ are separately provided for each of the coating heads 6, the feed screw mechanism will be needed for as many as the corresponding number of the moveable bodies. It is therefore preferable that the first moveable body $10_1$ and the second moveable body $10_2$ are arranged into a single constitution common to the plurality of coating heads as a whole.

DESCRIPTION OF REFERENCE NUMERALS AND CHARACTERS

6 inkjet coating head
6*d* nozzle
8 supporting body
$10_1$ first moveable body
$10_2$ second moveable body
$11_1$ first driving source
$11_2$ second driving source
12 converting mechanism
13 arm
$14_1$ first coupling part
$14_2$ second coupling part
15 linear scale

What is claimed is:

1. A rotational adjustment apparatus for an inkjet coating head, the apparatus being for performing a rotational adjustment, about a rotary axis in a Z-axis direction, of a linearly movable inkjet coating head, the Z-axis direction being orthogonal to an X-axis direction which is a direction of movement of the coating head, the apparatus comprising:

two moveable bodies made up of a first moveable body and a second moveable body, each being linearly moveable in the X-axis direction by an independent driving source; and a converting mechanism so constructed and arranged: that, when both the first moveable body and the second moveable body move synchronously in the X-axis direction, the inkjet coating head is linearly moved in the X-axis direction; and that, when both the moveable bodies make relative movements in the X-axis direction, the relative movements are converted to a rotary movement of the inkjet coating head about the rotary axis in the Z-axis direction.

2. The rotational adjustment apparatus for an inkjet coating head according to claim 1, wherein a relative positional relationship in the X-axis direction of both the moveable bodies is ascertained by a linear scale, and wherein a rotational angle of the inkjet coating head about the rotary axis is computed based on the positional relationship.

3. The rotational adjustment apparatus for an inkjet coating head according to claim 2, further comprising:

a plurality of the inkjet coating heads disposed in alignment in the X-axis direction;

a plurality of the converting mechanisms for the plurality of the inkjet coating heads;

a first driving source for linearly moving in the X-axis direction the one or the plurality of the first moveable bodies for the plurality of inkjet coating heads; and a second driving source for linearly moving in the X-axis direction the one or the plurality of the second moveable bodies for the plurality of inkjet coating heads.

4. The rotational adjustment apparatus for an inkjet coating head according to claim 2, wherein, let the direction orthogonal to the X-axis direction and to the Z-axis direction be defined as a Y-axis direction, the first movable body and the second movable body are disposed opposite to each other in the Y-axis direction on both sides of the rotary axis, wherein the converting mechanism is made up of:

an arm which is elongated in the Y-axis direction and is connected to the inkjet coating head so as to be rotatable about the rotary axis integrally with the inkjet coating head;

a first coupling part for coupling one end portion in the Y-axis direction of the arm to the first movable body while keeping two-axis freedom of movement in the Y-axis direction and of rotation about the axial line in the Z-axis direction; and a second coupling part which couples the other end part in the Y-axis direction of the arm to the second moveable body while keeping two-axis freedom of movement in the Y-axis direction and of rotation about the axial line in the Z-axis direction.

5. The rotational adjustment apparatus for an inkjet coating head according to claim 2, wherein, let the direction orthogonal to the X-axis direction and the Z-axis direction be defined as a Y-axis direction, the first movable body is made up of a supporting body which supports the inkjet coating head so as to be rotatable about the rotary axis, and the second movable body is disposed away from the rotary axis to one side in the Y-axis direction, wherein the converting mechanism is made up of:

an arm extending to one side in the Y-axis direction, the arm being connected to the inkjet coating head so as to be rotatable about the rotary axis integrally with the inkjet coating head; and a coupling part for coupling one end portion in the Y-axis direction of the arm to the second movable body while keeping two-axis freedom of a movement in the Y-axis direction and a rotation about the rotary axis in the Z-axis direction.

6. The rotational adjustment apparatus for an inkjet coating head according to claim 2, wherein the inkjet coating head comprises a plurality of nozzles arrayed in the direction orthogonal to the rotary axis.

7. The rotational adjustment apparatus for an inkjet coating head according to claim 1, further comprising:

a plurality of the inkjet coating heads disposed in alignment in the X-axis direction;

a plurality of the converting mechanisms for the plurality of the inkjet coating heads;

a first driving source for linearly moving in the X-axis direction the one or the plurality of the first moveable bodies for the plurality of inkjet coating heads; and a second driving source for linearly moving in the X-axis direction the one or the plurality of the second moveable bodies for the plurality of inkjet coating heads.

8. The rotational adjustment apparatus for an inkjet coating head according to claim 7, wherein, let the direction orthogonal to the X-axis direction and to the Z-axis direction be defined as a Y-axis direction, the first movable body and the second movable body are disposed opposite to each other in the Y-axis direction on both sides of the rotary axis, wherein the converting mechanism is made up of:

an arm which is elongated in the Y-axis direction and is connected to the inkjet coating head so as to be rotatable about the rotary axis integrally with the inkjet coating head;

a first coupling part for coupling one end portion in the Y-axis direction of the arm to the first movable body while keeping two-axis freedom of movement in the Y-axis direction and of rotation about the axial line in the Z-axis direction; and a second coupling part which couples the other end part in the Y-axis direction of the arm to the second moveable body while keeping two-axis freedom of movement in the Y-axis direction and of rotation about the axial line in the Z-axis direction.

9. The rotational adjustment apparatus for an inkjet coating head according to claim 7, wherein, let the direction orthogonal to the X-axis direction and the Z-axis direction be defined as a Y-axis direction, the first movable body is made up of a supporting body which supports the inkjet coating head so as to be rotatable about the rotary axis, and the second movable body is disposed away from the rotary axis to one side in the Y-axis direction, wherein the converting mechanism is made up of:

an arm extending to one side in the Y-axis direction, the arm being connected to the inkjet coating head so as to be rotatable about the rotary axis integrally with the inkjet coating head; and a coupling part for coupling one end portion in the Y-axis direction of the arm to the second movable body while keeping two-axis freedom of a movement in the Y-axis direction and a rotation about the rotary axis in the Z-axis direction.

10. The rotational adjustment apparatus for an inkjet coating head according to claim 7, wherein the inkjet coating head comprises a plurality of nozzles arrayed in the direction orthogonal to the rotary axis.

11. The rotational adjustment apparatus for an inkjet coating head according to claim 1, wherein, let the direction orthogonal to the X-axis direction and to the Z-axis direction be defined as a Y-axis direction, the first movable body and the second movable body are disposed opposite to each other in the Y-axis direction on both sides of the rotary axis, wherein the converting mechanism is made up of:

an arm which is elongated in the Y-axis direction and is connected to the inkjet coating head so as to be rotatable about the rotary axis integrally with the inkjet coating head;

a first coupling part for coupling one end portion in the Y-axis direction of the arm to the first movable body while keeping two-axis freedom of movement in the Y-axis direction and of rotation about the axial line in the Z-axis direction; and a second coupling part which couples the other end part in the Y-axis direction of the arm to the second moveable body while keeping two-axis freedom of movement in the Y-axis direction and of rotation about the axial line in the Z-axis direction.

12. The rotational adjustment apparatus for an inkjet coating head according to claim 11, wherein the inkjet coating head comprises a plurality of nozzles arrayed in the direction orthogonal to the rotary axis.

13. The rotational adjustment apparatus for an inkjet coating head according to claim 1, wherein, let the direction orthogonal to the X-axis direction and the Z-axis direction be defined as a Y-axis direction, the first movable body is made up of a supporting body which supports the inkjet coating head so as to be rotatable about the rotary axis, and the second movable body is disposed away from the rotary axis to one side in the Y-axis direction, wherein the converting mechanism is made up of:

an arm extending to one side in the Y-axis direction, the arm being connected to the inkjet coating head so as to be rotatable about the rotary axis integrally with the inkjet coating head; and a coupling part for coupling one end portion in the Y-axis direction of the arm to the second movable body while keeping two-axis freedom of a movement in the Y-axis direction and a rotation about the rotary axis in the Z-axis direction.

14. The rotational adjustment apparatus for an inkjet coating head according to claim 13, wherein the inkjet coating head comprises a plurality of nozzles arrayed in the direction orthogonal to the rotary axis.

15. The rotational adjustment apparatus for an inkjet coating head according to claim 1, wherein the inkjet coating head comprises a plurality of nozzles arrayed in the direction orthogonal to the rotary axis.

* * * * *